US005160380A

United States Patent [19]

Vocke et al.

[11] Patent Number: 5,160,380

[45] Date of Patent: Nov. 3, 1992

[54] PROCESS FOR IMPROVED PREPARATION OF TREATMENT GAS IN HEAT TREATMENTS

[75] Inventors: Peter Vocke, München; Thomas Mahlo, Geretsried; Reinhard Strigl, München, all of Fed. Rep. of Germany

[73] Assignee: Linde Aktiengesellschaft, Wiesbaden, Fed. Rep. of Germany

[21] Appl. No.: 701,156

[22] Filed: May 17, 1991

[30] Foreign Application Priority Data

May 19, 1990 [DE] Fed. Rep. of Germany ..... 4016183

[51] Int. Cl.[5] ..... F27D 23/00; C21D 1/00; C21D 9/00

[52] U.S. Cl. ..... 148/206; 148/559; 423/239; 423/245.3; 423/651

[58] Field of Search ..... 423/239, 245.3, 651; 148/20.3, 206

[56] References Cited

U.S. PATENT DOCUMENTS

| | | | |
|---|---|---|---|
| 3,535,074 | 10/1970 | Nakashima | 23/2 |
| 4,398,971 | 8/1983 | Peterson | 148/16 |
| 4,417,927 | 11/1983 | Fullman | 148/20.3 |
| 4,531,984 | 7/1985 | Madsac | 148/20.3 |
| 4,596,610 | 6/1986 | Kühn | 148/16.5 |
| 5,069,728 | 12/1991 | Rancon et al. | 266/81 |

FOREIGN PATENT DOCUMENTS

| | | |
|---|---|---|
| 0261462 | 9/1987 | European Pat. Off. . |
| 2758024 | 10/1978 | Fed. Rep. of Germany . |
| 3630833 | 3/1988 | Fed. Rep. of Germany . |
| 3632577 | 5/1988 | Fed. Rep. of Germany . |

*Primary Examiner*—Upendra Roy
*Attorney, Agent, or Firm*—Millen, White, Zelano and Branigan

[57] ABSTRACT

The invention relates to a process and apparatus for preparation of treatment gas used in heat treatments, whereby the treatment gas is produced in a furnace disposed catalyst retort at a temperature of that of the furnace in which the retort is positioned.

With such processes, when using lower furnace temperature ranges, problems occur with respect to the reaction of the feed gas in the catalyst retort. To provide an improvement, the catalyst retort in the furnace is surrounded by a shield, and the treatment gas generated in and leaving the catalyst retort is first fed into a space defined by this shield and thereafter released into furnace space. By this, an isolation of the catalyst retort from the interior of the furnace is provided, and relatively higher retort temperatures are available.

17 Claims, 1 Drawing Sheet

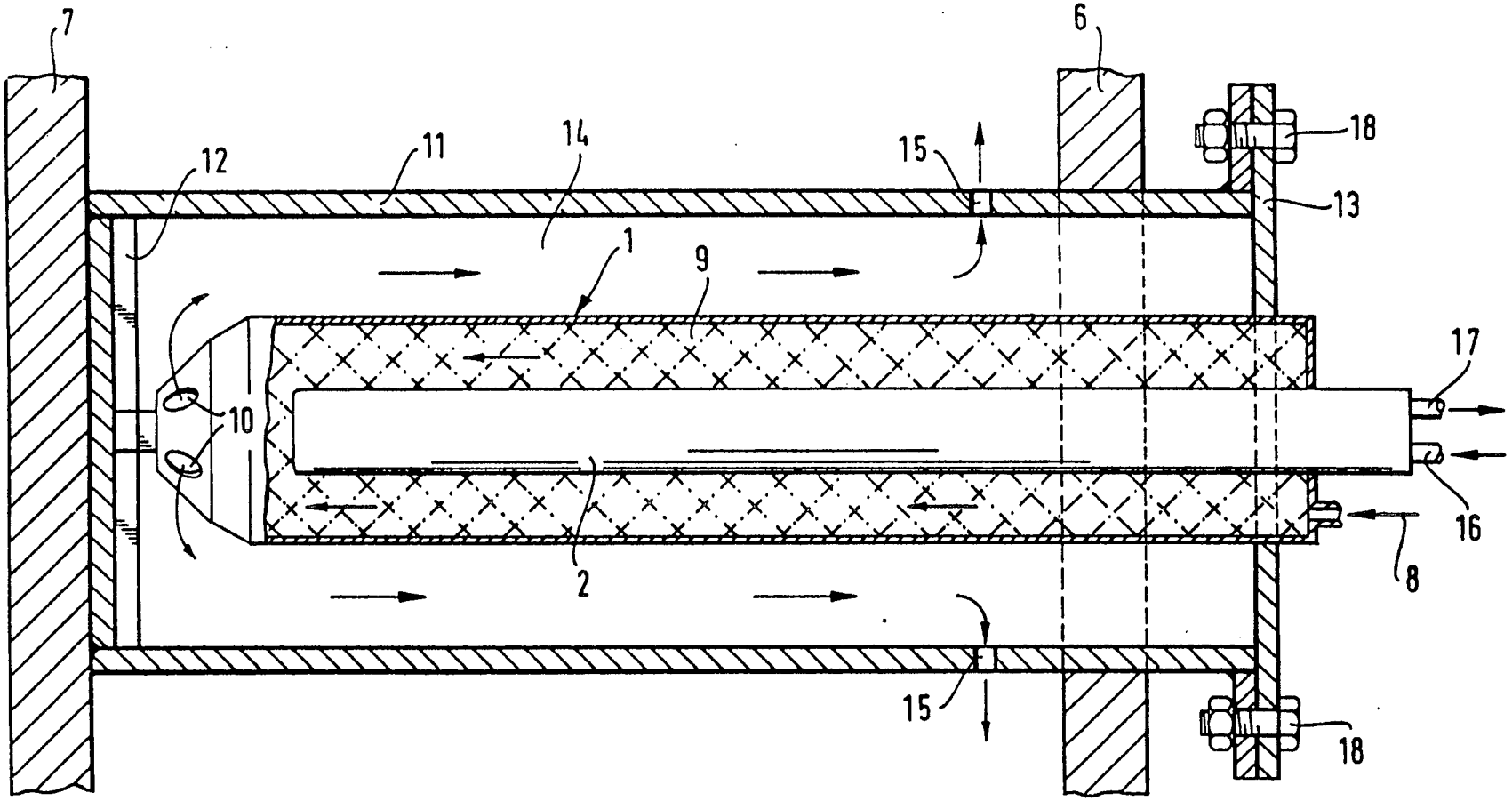
17
16
8
18
13
18
6
15
15
9
1
2
14
11
10
12
7

PROCESS FOR IMPROVED PREPARATION OF TREATMENT GAS IN HEAT TREATMENTS

BACKGROUND OF THE INVENTION

The invention relates to a process for preparation of treatment gas used in heat treatments, whereby the treatment gas is produced in a furnace disposed catalyst retort at a temperature of that of the furnace. The invention also relates to a corresponding device for carrying out the inventive process. The phrase "catalyst retort at a temperature of that of the furnace" means that the retort temperature is at or near the temperature level of the inside of the furnace.

There are known many heat treatment processes, especially processes for heat treatment of metal workpieces, which involve the use of a catalyst retort placed in the hot areas of a heat treatment furnace for the production of a treatment gas (a protective or reaction gas). See, e.g., DE-OS 36 30 833. In operation, a feed gas is fed to these retorts wherein, due to the presence of the catalyst and the existing temperature level imposed by the furnace environment, the feed gas is reacted to the desired treatment gas. The resultant treatment gas then flows directly from the catalyst retort into the furnace interior.

However, in heat treatments wherein the ambient temperature for the catalyst retort is below 800° C., problems can occur with respect to complete reaction of the feed gas due to the relatively low temperature level. These problems can be eliminated, within certain bounds, in self-heated catalyst retorts by raising the heat output of a burner positioned inside the catalyst retort and adjacent to the catalyst material. But, at a certain lower temperature limit, about 750° C., thorough warming of the catalyst mass becomes insufficient because of excessive heat outflow from the retort to the "too cold" furnace space. This in turn causes the reaction of the feed gas into the treatment gas to be insufficient.

On the other hand, if heating output is further increased, there is a danger that a burning through of the catalyst retort will occur. The catalyst retort, in general, is designed as a pipe with catalyst material placed on the outside thereof and a heating burner positioned on the inside thereof. Such tubular catalyst retorts equipped with their own heating means are known from, e.g., DE-OS 27 58 024 or DE-OS 36 32 577.

Moreover, with such catalyst retorts there is the problem that in situations where replacement of the retort becomes necessary a temporary shutdown of the furnace has to take place.

SUMMARY OF THE INVENTION

An object of the invention is to improve processes for preparation of treatment gas for use in heat treatments, as well as improving known catalyst retorts to increase their usability at lower operating temperatures in heat treatments.

Upon further study of the specification and appended claims, further objects and advantages of this invention will become apparent to those skilled in the art.

These objects are achieved by surrounding a catalyst retort positioned in a furnace by a shield and by first feeding the treatment gas leaving the catalyst retort into the space defined by the shield and thereafter is released into the furnace space.

By this feature, the catalyst retort is insulated relative to the gas atmosphere present in the furnace interior and freshly produced treatment gas is initially delivered to a space defined by the shield which surrounds the catalyst retort. Consequently, even at furnace temperatures below 750° C., a higher thorough warming of the catalyst mass in the catalyst retort can be maintained. As a result, a more complete reaction of the feed gas into treatment gas can be obtained. Also, the danger of the catalyst retort burning through is eliminated, since the heat output of the catalyst retort burner can be set at a lower level than those situations where a shield is not present.

Thus, according to a process aspect, the invention comprises a process for the preparation of treatment gas for use in a heat treatment, comprising:

producing treatment gas in a catalyst retort at a temperature above that of a furnace in which the catalyst retort is positioned by surrounding the catalyst retort within the furnace by a shield;

discharging the treatment gas from the catalyst retort into a space defined between the shield and the retort; and discharging the treatment gas from the space into the furnace An advantageous configuration of the invention for a typical tubular catalyst retort, derived from a heating jet pipe, comprises surrounding the retort with an also substantially tubular shield, which envelops the catalyst retort at a distance, and conducting the formed treatment gas, before introduction into the furnace space, within the shield for as long a distance as possible.

A device according to the invention comprises a substantially tubular catalyst retort, having a jacket pipe, heating means, catalyst material and gas feed and discharge devices as well as gas outlet openings for the produced treatment gas, which is connected to a casing pipe (a shield), having a circular cross section or other suitable shape, so that the catalyst retort is placed approximately coaxially and centered within the casing pipe, thereby forming a free space surrounding the catalyst retort, the casing pipe being provided with passages for the discharge of treatment gas collected therein.

According to an especially advantageous configuration of the invention, discharge passages are positioned in the casing pipe so that the flow path of newly formed treatment gas within the casing pipe is as long as possible. With this configuration, freshly produced treatment gas, which leaves the catalyst retort at a higher temperature level, remains as long as possible in the vicinity of the retort thereby keeping the latter at a higher temperature level.

Preferably, the treatment gas flows a distance within the shield which is substantially equal to the distance which the shield extends into the furnace, i.e., substantially equal to the length of the shield. For example, for a substantially tubular shield having a longitudinal axis, a first end, and a second end, the treatment gas enters the region defined by the shield at a point adjacent said first end and it is discharged from the shield at a point adjacent the second end, whereby the treatment gas flows within the zone defined by the shield for a distance which is at least substantially equal to the length of the longitudinal axis of the shield.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosures of all applications, patents and publications, cited above and below, and of corresponding application Federal Republic of German P 40 16 183.8, filed May 19, 1990, are hereby incorporated by reference.

The invention is suitable for processes wherein metal workpieces are subjected to a heat treatment in a furnace in the presence of a treatment gas such as a mixture of CO, $H_2$ and $N_2$ obtained from catalytic conversion of a natural gas/air mixture or a mixture of $N_2$ and $H_2$ obtained from $NH_3$. Heat treatments for which the invention is suitable include carburizing, decarburizing and many kinds of annealing processes.

In accordance with the invention, the operating temperatures of both the furnace and the catalyst retort can vary within wide ranges. Generally, a furnace according to the invention operates at a temperature of about 600° to 800° C., preferably 720° to 800° C., and the catalyst retort is heated to a temperature of about 800° to 1050° C., preferably 880° to 1000° C.

Several different types of catalyst can be used within the catalyst retort. Suitable catalysts include Ni-catalysts or noble metal catalysts, e.g., platinum. The reactions which are supported by the catalysts in association with the invention are typically $CH_4+\frac{1}{2}O_2+1.9N_2 \rightarrow CO+2H_2+1.9N_2$ or $2NH_3 \rightarrow N_2+3H_2$.

BRIEF DESCRIPTION OF THE DRAWINGS

Various other objects, features and attendant advantages of the present invention will be more fully appreciated as the same becomes better understood when considered in conjunction with the accompanying drawing which illustrates a cross-sectional view of a catalyst retort with shield.

DETAILED DESCRIPTION OF THE DRAWING

The figure shows a device according to the invention —with a catalyst retort 1, internal heating means 2 and a shielding casing pipe 11—installed between two walls 6, 7 of a heat treatment unit. The substantially tubular catalyst retort 1 is equipped with a feed pipe 8 for introduction of a feed gas, which, for example, can be a mixture of natural gas and air. The inside volume of retort 1 for the most part is filled with catalyst material 9, for the reaction wherein the feed gas is converted into a treatment gas. Outlet openings 10 for the reacted gas are provided on the end of retort 1 which is opposite feed pipe 8.

In operation the feed gas passes through catalyst material 9 present in the catalyst retort and leaves the retort as treatment gas through gas outlet openings 10. Internal heating means 2 is placed centrally in the catalyst retort and, for example, consists of a burner with combustible gas mixture feed means 16 and exhaust gas pipe 17 The entire catalyst retort 1 is surrounded by a shield or casing pipe 11. The retort is fastened coaxially within the casing pipe and is centered with cross struts 12 and a flange 13. In this case, because of the greater diameter of the casing pipe, preferably about 1.1 to 2 times larger than the diameter of the retort, a free space 14 between the catalyst retort and casing pipe results. Passages 15 are placed in casing pipe 11 approximately at the end which is opposite to the end where gas outlet openings 10 are located on the retort itself. As a result the exterior of the retort is in contact almost over its entire length with constantly inflowing, freshly formed, warm treatment gas.

EXAMPLE

An example of the operation of the invention is as follows:

If a heat treatment at a temperature of, for example about 750° C., is to be performed under protective gas, e.g., an annealing of metal workpieces, and the heat treatment unit is a continuous furnace of conventional design with protective gas production by catalyst retorts, the problems explained above can occur, i.e., incomplete reaction of the feed gas into the treatment gas and the danger of burn-through at high heating output. However, by using the process and device according to the invention, a problem-free preparation of the treatment gas is possible.

According to the invention, with an approximately constant heat output for heating the catalyst retort, a more thorough warming of the catalyst material in the retort to an approximately 10 to 20% higher temperature level is achieved than if a catalyst retort without a casing pipe 11 were used. The natural gas-air feed gas in a relatively cold state flows by pipe 8 into catalyst mass 9 and, after heating, reacts to form, for example, a treatment gas containing $CO/H_2/N_2$. The treatment gas flows out of the retort through gas outlet openings 10, located on the tip of the catalyst retort, and into free space 14 shielded by casing pipe 11. In this shielded free space, the treatment gas flows to the opposite end of the catalyst retort where through-holes or discharge passages 15 of casing pipe 11 are located. Finally, via discharge passages 15, the treatment gas is discharged from casing pipe 11 and enters into the furnace interior. In this way, a heat insulation of the catalyst retort with respect to the furnace interior is achieved, as a result of which the above-mentioned raising of the temperature level in the catalyst retort, a goal of the invention, is achieved.

Another advantage associated with the process and/or apparatus aspects of the invention, is that the replacement of a catalyst retort can be substantially simplified. If the device according to the invention is configured so that casing pipe 11 is, for example, connected to flange 13 by a detachable screw connection 18 and a first end of catalyst retort 1 is attached to flange 13 while the other end of the catalyst retort is loosely positioned in casing pipe 11 on cross struts 12, a replacement of the catalyst retort can take place during continuous operation of the treatment furnace in a practical manner. Such replacement is possible because casing pipe 11 remains in the furnace so that the latter continues basically to be closed. Thus, the catalyst retort can be replaced in a very simple way while the furnace is heated, thereby reducing costs for this method of operation.

Therefore, besides the main object of the invention, namely to provide an insulating layer between a catalyst retort installed in a furnace and the furnace interior, the increase in the ease of maintenance of a furnace unit by catalyst retorts configured according to the invention is an essential point in regard to the economical evaluation of this invention.

The process according to the invention thus provides an expansion of the possibilities of treatment gas production with catalyst retorts, which can be desirable and advantageous in many practical cases. Additionally, substantial advances are made in regard to ease of maintenance and repair of a heat treatment unit.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

We claim:

1. A process for the preparation of treatment gas for use in heat treatment of metal workpieces, said treatment gas consisting essentially of (a) CO, $H_2$ and $N_2$, or (b) $H_2$ and $N_2$, comprising:

producing treatment gas in a catalyst retort at a temperature above that of a furnace in which said catalyst retort is positioned, said furnace operating at a temperature of 600°-800° C. by surrounding said catalyst retort within said furnace by a shield;

discharging the produced treatment gas from said catalyst retort into a space defined between said shield and said retort; and discharging said produced treatment gas from said space into said furnace.

2. A process according to claim 1, wherein both said catalyst retort and said shield are substantially tubular, and said treatment gas, before introduction into said furnace, is conducted along a flowpath within said space, said flowpath having a length substantially equal to the length of said shield.

3. A process according to claim 1, wherein ammonia or a gaseous mixture of natural gas and air is fed to said catalyst retort to form said treatment gas.

4. A process according to claim 1, wherein said catalyst retort is heated internally by heating means positioned therein.

5. A process according to claim 1, wherein said catalyst retort is substantially tubular and comprises a jacket pipe, heating means, catalyst material, gas feed means and gas outlet openings for discharging treatment gas produced therein into said space; and said shield comprises a casing pipe connected to said catalyst retort, said catalyst retort being positioned within said casing pipe and being approximately coaxial therewith, whereby said space is defined, and said casing pipe is provided with discharge passages whereby treatment gas from said space can be discharged into said furnace.

6. A process according to claim 1, wherein said furnace operates at a temperature of 720°-800° C.

7. A process according to claim 1, wherein said catalyst retort is heated to a temperature of 800°-1050° C.

8. A process according to claim 1, wherein the catalyst within said catalyst retort is a nickel or nobel metal catalyst.

9. A process according to claim 2, wherein the diameter of said shield is 1.1 to 2 times larger than the diameter of said catalyst retort.

10. A process according to claim 3, wherein said furnace is operated at a temperature below about 750° C.

11. A process according to claim 3, wherein said heat treatment is a carburizing or an annealing process of metal workpieces.

12. A process according to claim 3, wherein a gaseous mixture of natural gas and air is fed to said catalyst retort and reacted therein to form said treatment gas, said treatment gas containing CO, $H_2$ and $N_2$.

13. A process according to claim 3, wherein ammonia is fed to said catalyst retort and reacted therein to form said treatment gas, said treatment gas consisting essentially of $H_2$ and $N_2$.

14. A process according to claim 5, wherein said discharge passages are positioned in said casing pipe at a point opposite that of said gas outlet openings of said retort.

15. A process according to claim 5, wherein both said catalyst retort and said casing pipe are substantially tubular.

16. A process according to claim 7, wherein said catalyst retort is heated to a temperature of 880°-1000° C.

17. A process according to claim 15, wherein the diameter of said casing pipe is 1.1 to 2 times larger than the diameter of said catalyst retort.

* * * * *